United States Patent [19]

Schoell

[11] 3,942,464

[45] Mar. 9, 1976

[54] WATER JET PROPELLING APPARATUS FOR BOATS

[76] Inventor: Harry L. Schoell, 19611 NW. 39th Court, Miami, Fla. 33054

[22] Filed: Aug. 23, 1974

[21] Appl. No.: 499,896

Related U.S. Application Data

[63] Continuation-in-part of Ser. No. 379,198, July 13, 1973, Pat. No. 3,834,342.

[52] U.S. Cl. ..... 115/12 R; 60/221; 114/151

[51] Int. Cl.[2] ..... B63H 11/10

[58] Field of Search ..... 115/11, 12 R, 12 A, 14, 115/16, 34 R, 41 R; 60/221, 229, 230; 114/66.5 R, 151

[56] References Cited

UNITED STATES PATENTS

| | | | |
|---|---|---|---|
| 3,044,260 | 7/1962 | Hamilton | 115/16 |
| 3,146,586 | 9/1964 | Newby | 115/14 |
| 3,187,708 | 6/1965 | Fox | 115/12 R |
| 3,336,752 | 8/1967 | Smith | 115/12 R |

*Primary Examiner*—Trygve M. Blix
*Assistant Examiner*—Charles E. Frankfort

[57] ABSTRACT

A water propulsion device for boats having a plurality of housings bolted together so as to be partially submerged in water requiring no lift and a minimum of drag to the water passing horizontally therethrough. A shoulder on each side of the housing prevents water from flowing over the housing. A vertical wall in the housing divides the water into two jet streams whose reactive forces are imparted to the boat, each of which water jet impinges on an arcuate deflector plate to effect the steering of the boat. The steering mechanism consists of a slide bar whose position determines the forward and rearward movement of the boat while a cam plate and turn arm cooperate to determine the turning moments of the boat.

5 Claims, 31 Drawing Figures

WATER JET PROPELLING APPARATUS FOR BOATS

CROSS REFERENCES TO RELATED APPLICATIONS

This application is a continuation in part of my copending application Ser. No. 379,198 issued as U.S. Pat. No. 3,834,342, on Sept. 10, 1974, for Water Jet Propulsion Device.

BACKGROUND OF THE INVENTION

1. Field Of The Invention

This invention relates to boat propulsion devices and is more particularly directed to one utilizing a plurality of water jets whose reactive forces propel the boat.

2. Description Of The Prior Art.

As stated in my copending application there are generally two types of water jet propulsion devices for boats in use at present, namely one which is completely submerged in the water and the other which is mounted on a boat above the water. Both of these jet propulsion devices are very inefficient. The jet device that is completely submerged develops a great deal of drag and resistance due to the water surrounding the jet pump, while the device completely out of the water must lift the water entering the device and change the direction of flow of water which requires work being done on the water in having it pass through the device thereby reducing the efficiency of the propulsion device. Also, these devices require that the structure of the boat be modified or changed to adapt the device to the boat. Some require a large opening be made in the hull and stern of the boat to permit the flow of water into the device. The present invention contemplates avoiding all of the disadvantages of the present water jet propulsion devices as well as making certain improvements over my patented water jet propulsion device.

SUMMARY OF THE INVENTION

Therefore, a principal object of the present invention is to provide an improved steering mechanism for a water jet propulsion apparatus that is simple in construction, readily operated by the user for directing the movement of the boat on which it is affixed in the same manner as that of a propeller driven apparatus.

Another object of the present invention is to provide a housing for a water jet propulsion device consisting of a plurality of castings bolted to each other wherein the casting that houses the impellers and is subject to wear by virtue of the abrasive action of the water flowing through may be removed and replaced without having to dismantle the entire apparatus.

A further object of the present invention is to provide a water jet propulsion apparatus for boats that is partially submerged in water with shoulders along both sides thereof in coplanar alignment with the hull of the boat and with the end portion of the apparatus being arcuate and recessed inwardly of the shoulders so that water flowing along the outer surface of the apparatus will be deflected away from the apparatus and thereby reduce water drag to a minimum.

A still further object of the present invention is to provide a steering mechanism for a water jet propulsion apparatus for boats consisting of two control members wherein one control member effects the movement of the boat in a forward or rearward direction as well as placing the apparatus in a neutral position while the other control effects only the turning movement of the boat.

With these and other objects in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

BRIEF DESCRIPTION OF THE DRAWINGS

In the drawings:

FIGS. 8A—12A inclusive are cross sectional views taken along the lines 8A—8A of FIG. 6 correlated with FIGS. 8–12 respectively as to the positions of the deflecting members with relation to the slide bar.

FIGS. 8B–12B inclusive are cross sectional views taken along the lines 8B—8B of FIG. 6 correlated with FIGS. 8–12 and 8A–12A, respectively as to the positions of the deflecting members, the slide bar and the cam plate.

FIGS. 8C–12C respectively are top plan views of my water jet propulsion device, correlated with FIGS. 8–12 inclusive, 8A–12A inclusive, 8B–12B inclusive, respectively, as to the positions of the deflecting members with relation to the steering mechanism.

Figure 1:
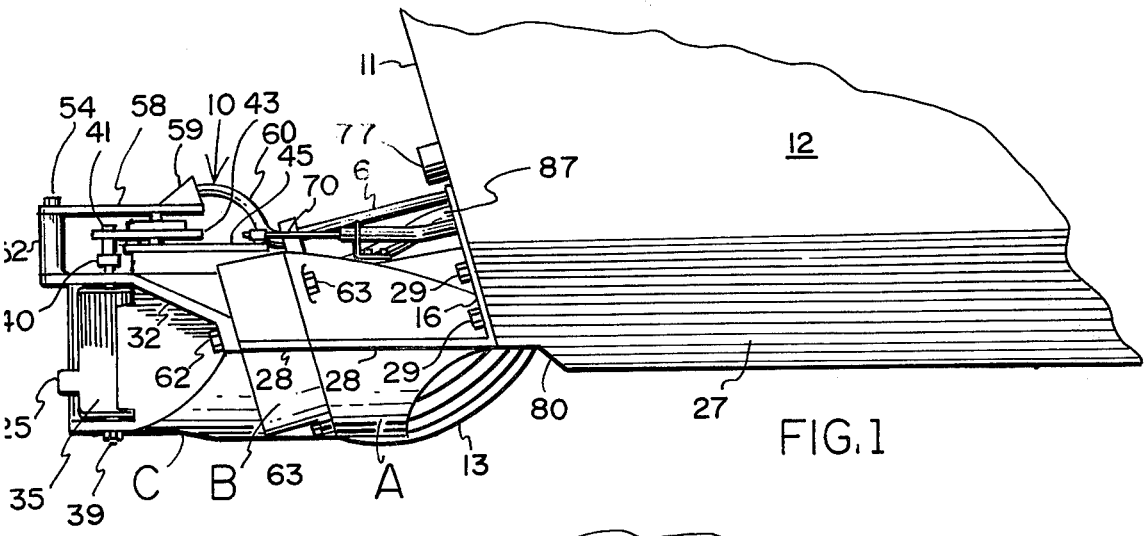
FIG. 1 is a side elevational view of my water jet propelling apparatus mounted on a boat shown only in part.
Figure 2:
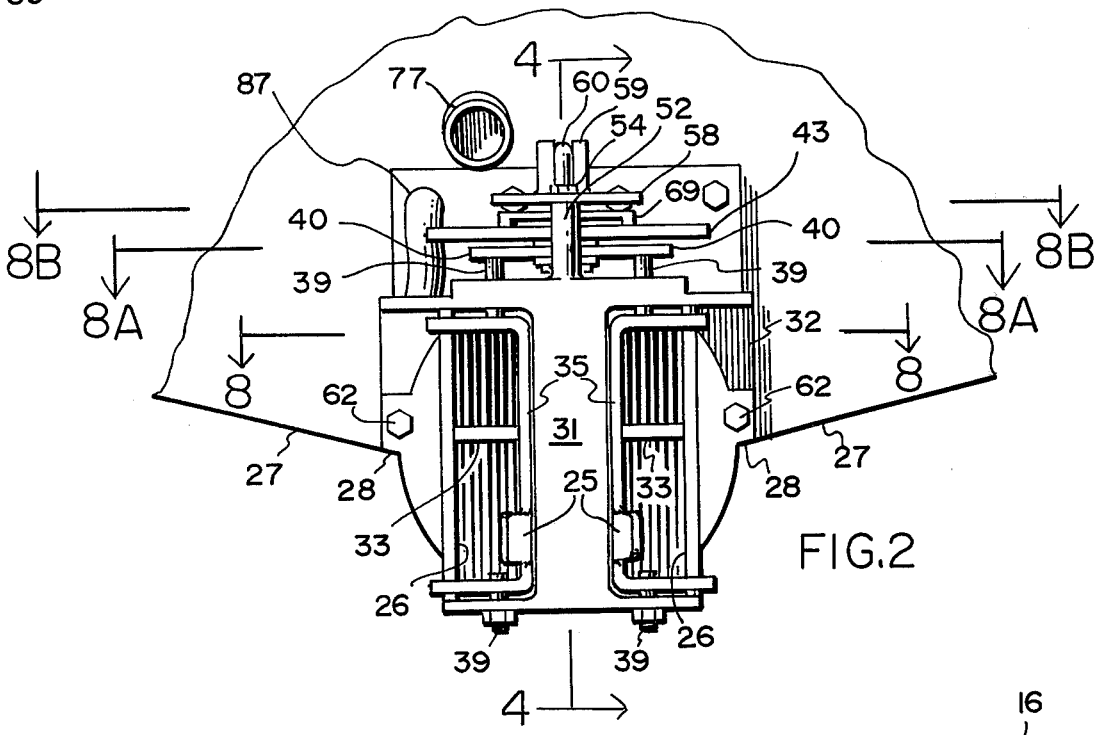
FIG. 2 is a rear elevational view thereof.
Figure 3:
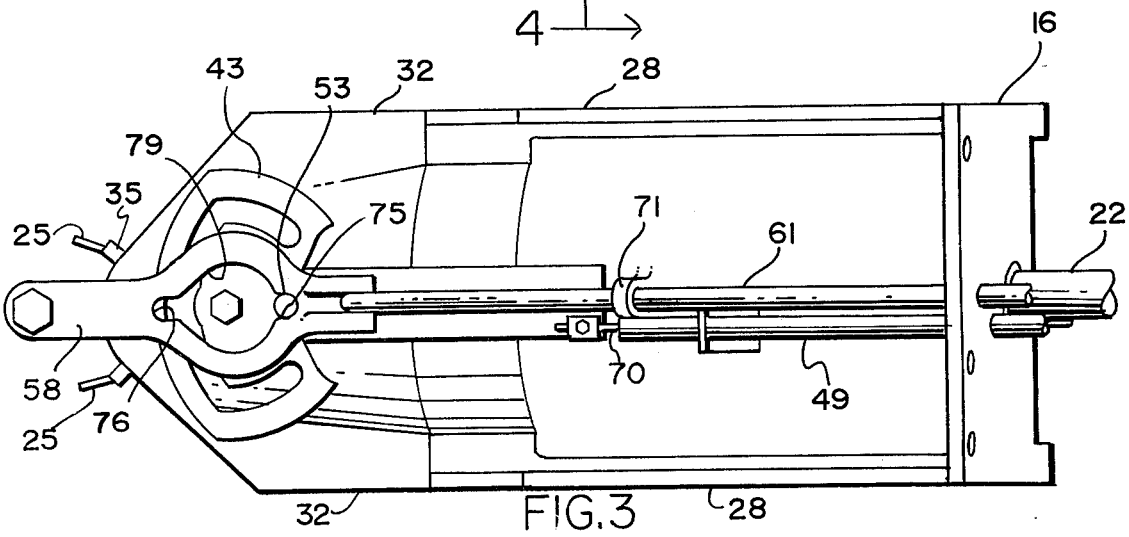
FIG. 3 is a top plan view of the apparatus only.
Figure 4:
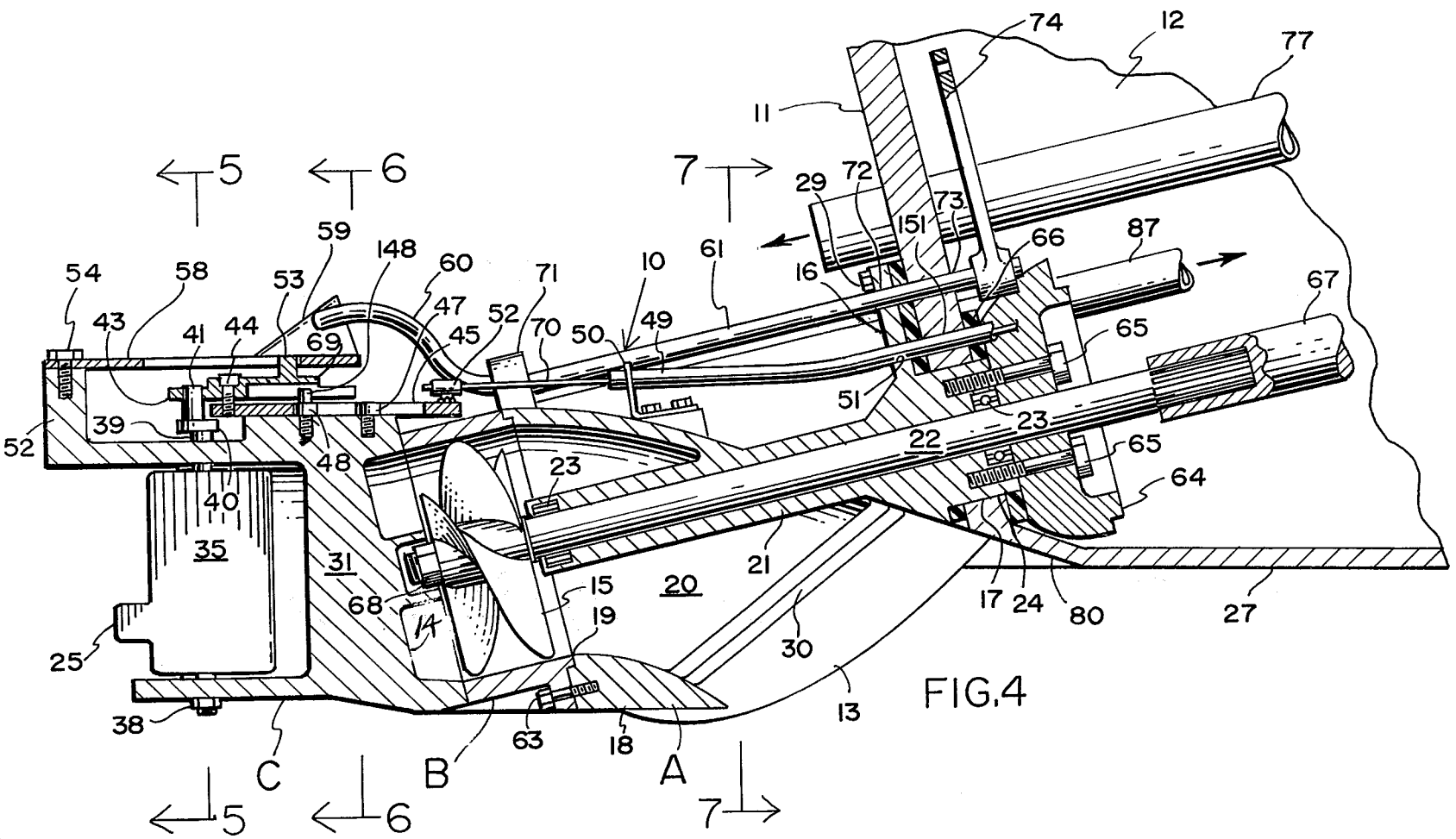
FIG. 4 is a longitudinal cross sectional view taken along the line 4—4 of FIG. 2.
Figure 7:
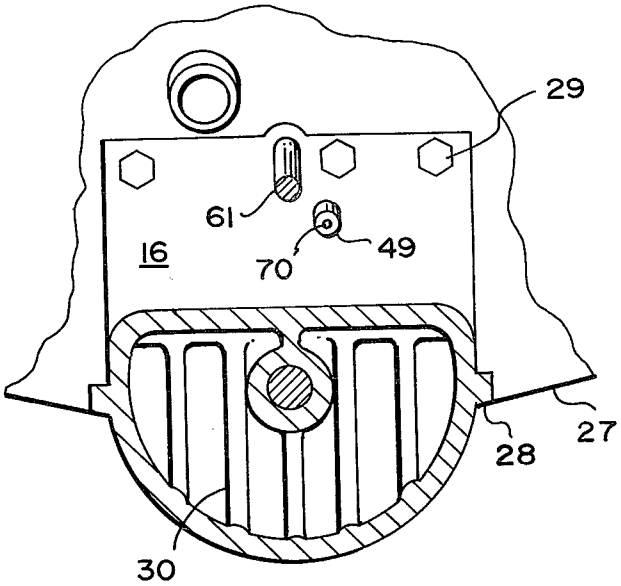
FIGS. 5, 6 and 7 are transverse cross sectional views taken along the lines 5—5, 6—6 and 7—7 respectively of FIG. 4.
Figure 6:
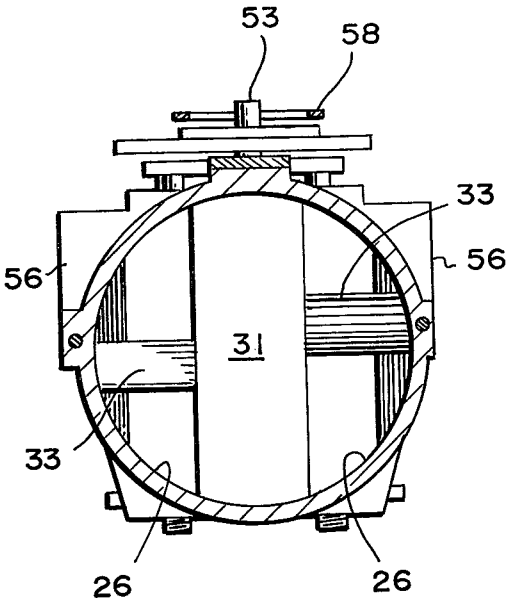
Figure 5:
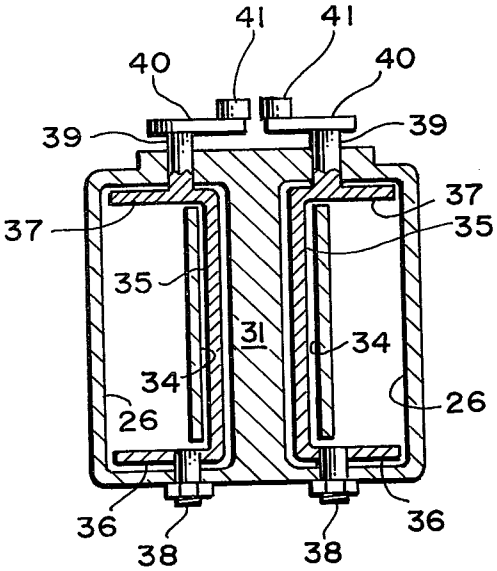

Referring to the drawings wherein like numerals are used to designate similar parts throughout the several views, the numeral 10 refers to a water jet propulsion device constructed in accordance with my invention and shown in position fastened to the transom 11 of a boat 12 and extending rearwardly of the boat 12 with a water inlet opening 13 below the hull 27 of the boat 12 to permit a substantially horizontal flow of water into and through the jet propulsion device 10.

The housing of my jet propulsion device 10 consists of a plurality of castings —A—, —B— and —C— bolted together by bolts 62 and 63, the bolts 62 securing the casting —C— to —B— while the bolts 63 secure the casting —B— to —A—. The forward casting —A— has a somewhat cylindrical housing 18 having a front support plate 16 that lies against the transom 11 to which it is fastened by bolts 29. The housing 18 is provided with the water inlet 13, an outlet 19 and a water passageway 20 extending approximately horizontally therethrough. At the inlet 13 there is a plurality of spaced rods 30 that permit water to pass therethrough but prevents objects from entering the water jet device that would otherwise damage the water impeller 15.

My jet propulsion device 10 is fastened securely to the boat 12 by a hub 17 extending from the support plate 16 through an opening 24 in the transom 11 and having a locking plate 64 mounted against the inner surface of the transom 11. Bolts 65 fasten the hub 17 to the locking plate 64 with a gasket 66 placed therebetween to prevent the leakage of water into the boat 12.

A tubular shaft support 21 extends through the center of the locking plate 64, hub 17 and support plate 16 to a position adjacent the outlet 19 of the housing 18. An impeller shaft 22 rotatably mounted in the shaft support 21 extends inwardly of the boat 12 where the shaft 22 is connected to a motor shaft 67 which in turn is connected to a source of rotational power (not shown). At its outer end the impeller shaft 22 there is an impeller 15 mounted and secured thereon by a nut 68. The impeller 15 is positioned within the confines of the casting or wear ring —B— which after considerable use of the jet propulsion device 10 the inner surface of the wear ring —B— will become worn and the clearance between the tips of the impeller 15 and the walls of the wear ring —B— becomes excessive at which time the device 10 then runs inefficiently. By merely removing the bolts 63, the wear ring —B— can be readily removed and replaced by a new wear rings —B—. The drive shaft 22 is journalled by bearings 23 at each end of the shaft support 21.

Along each side of the castings —A— and —B— are shoulders 28 that are in horizontal coplanar alignment with the bottom surface or hull 27 of the boat 12 forming water planing members. Water which flows along the outer surface of the hull 27 as the boat 12 moves forwardly will either enter the jet propulsion device 10 at the inlet 13 or flow around the housing 18. The water that does not flow into the inlet 13 will flow about the housing 18 and impinge against the lower surface of the shoulders 28 to prevent the water from flowing over the top of the housings —A— and —B—, but instead deflect the water sidewardly and away from the propulsion device 10 thereby reducing the drag effected by the water to a minimum.

The casting —C— secured to the free end of the casting —B— by the bolts 62 is cylindrical in cross section at its forward or connected end portion and rectangular at the rear end portion to form two separated rectangular water passageways 26. The water passageways 26 are separated by a vertically disposed wall 31 that is rectangular in cross section at its rear portion. At the forward end portion adjacent the impeller 15, the divider wall 31 has been ground to a knife edge as at 14 and curved along approximately half the length of the wall 31 to form a pair of radially extending water flow straightening vanes at the forward portion of the divider wall 31. At right angle to the divider wall 31 and on each side thereof is a pair of second water flow straightening vanes 33 that extend from the forward edge of the casting —C— to the mid-portion thereof. On each side of the casting —C— there is a water deflecting shoulder 32 that extends diagonally from the top of the casting —C— at the discharge end thereof to the shoulders 28 at the position of the bolts 62. The shoulders 32 as does the shoulders 28, prevent the water from flowing over the device 10 as it moves along the water to reduce drag to a minimum.

At the rear or discharge end portion of the casting —C— the divider wall 31 is provided with a pair of vertically disposed arcuate slots 34 that extend to the rear edge and receive arcuate water deflector members 35 for steering the boat 12. The deflectors 35 are each provided with tabs 36 and 37 at the bottom and top ends that extend at right angle to the deflector members 35. The lower tabs 36 are pivoted about a pivot pin 38 secured to the lower surface of the casting —B—. The upper tabs 37 are provided with a stem 39 that extends upwardly through an opening and beyond the upper surface of the casting —C—. The free end of each of the stems 39 are secured to one end of a crank 40 while the other end of the cranks 40 have a pivot pin 41 rotatably mounted thereon. Along the outer edges of each of the deflectors 35 is a water deflecting tab 25 whose function is explained hereinafter.

The upper ends of the pivot pins 41 are received in a cam slot 42 formed in a cam plate 43. The cam slot 42 is symmetrically disposed on each side of the cam plate 43 and forms a generally *c* shape with each pivot pin 41 so disposed as to slide only along one-half of the slot 42. The cam plate 43 is pivotally mounted by a pivot pin 44 for rotational movement, the pivot pin 44 being mounted on a slide bar 45 mounted for sliding longitudinally along the top surface of the castings —B— and —C—.

The position of the slide bar 45 determines the direction the boat 12 is moving, that is forward, rearward or in neutral while the position of the cam plate 43 determines the turning movement of the boat, that is, to the right or left, all of which is explained in detail hereinafter.

The slide bar 45 is guided in its sliding movement by a slot 46 formed in the slide bar 45 and a pair of pins 47 and 48 secured to the upper surface of the castings —C— and received by the slot 46. The pins 47 and 48 limit the sliding movement of the slide bar 45 in each direction upon the pins 47 and 48 engaging the bar 45 at the ends of the slot 46. The sliding movement of the slide bar 45 is controlled by a pull rod or cable 70 secured as at 52 to the slide bar 45 and whose sheath 49 is secured to the casting —A— by a bracket 50. The control cable 70 and sheath 49 extend through an opening 51 and 151 in the support plate 16 and transom 11 and extend to an operating member (not shown). The control cable 70 which effects the sliding movement of the slide plate 45 and cam 43 controls the forward and reverse movement of the boat 12 as well as placing the jet propulsion device 10 in neutral as is explained in detail hereinafter.

The cam plate 43 is provided with a second cam slot 57 formed in the shape of a "U" and centered on the cam plate 43 between the leg portions of the slot 42. The cam slot 57 receives a pin 148 that extends upwardly of a pin 48. An opening 85 in the cam plate 43 permits the pin 148 to slide in and out of the second cam slot 57 as the slide bar 45 is actuated. The arcuate edge portions 86 of the cam plate 43 form a stop for the cam plate 43 as the latter is pivoted about its pivot pin 44. A cover plate 69 extends over the cam slot 57 and is mounted in space relation to the cam plate 69 by means of spacer wall 78 positioned along the edges of the cam cover plate 69. This permits the free swinging movement of the pin 53 that effectuates the swinging of the cam plate 43 about its pivot pin 44 in the turning of the boat 12.

Pivotally mounted above the combined cam plate 43 and cover plate 69 is a swing arm 58 pivoted to the post 52 as at 54 at one end, while the other end has mounted thereon a pair of spaced wall members 59. The swing arm is actuated by a swing bar 61 that is rotatably supported by a bracket 71 mounted on the housing —A—. The swing bar 61 extends through openings 72 and 73 into the boat 12 where a handle 74 is mounted for rotating the swing bar 61. The other end of the swing bar 61 is curved as at 60 and received between the spaced wall members 59 so that upon actuation of the handle 74, the swing bar 61 will rotate and cause the arcuate end portion 60 to swing and pivot the swing arm 58 about the pin 54.

The swing arm 58 is provided a somewhat circular enclosed slot 79 having aligned openings 75 and 76 at each end thereof. A pin 53 mounted on the cam cover plate 69 extends upwardly to engage the inset opening 75 when the boat 12 is moving forwardly and the cam plate 43 is engaged to steer the boat to the right or left. Likewise the inset opening 76 is engaged by the pin 53 when the boat is moving directly sternwise and in position to swing the cam plate 43 to right or left upon actuation of the steering handle 74.

By virtue of the above described structure, upon pivotal movement of the cam plate 43 on its pivot pin 44, the crank pins 41 will be made to slide along their half of the cam slot 42 to cause swinging movement of the cranks 40 and the deflector plates 35 to pivot about their pivot pins 38 and stems 39. Pipes 87 and 77 are intake and discharge water lines for cooling the engine (not shown) that operates the impeller 15. Tabs 25 are mounted on the outer edge of each of the water deflector members 35 to assist the latter in their swinging movement in and out of their respective slots 34 and especially to prevent a suction effect that would ten to slide the deflectors 35 out of their slots 34.

In order to mount my water jet propulsion device 10 to the transom 11 of the boat 12, all that need be done is to provide three openings 24, 51 and 73 for the combined hub 17 and drive shaft 22, control cable 49 and steering shaft 83 respectively. The hull 27 of the boat at the keel thereof adjacent the transom 11 is flattened and inclined upwardly as at 80 to expose the entire opening or inlet 13 of my water jet propulsion device 10 to provide an unobstructed horizontal flow of water into the inlet 13 of my water jet propulsion device 10.

The device 10 is mounted so that the shoulders 28 along both sides of the castings —A— and —B— will lie in coplanar relation with the hull 27. The casting —C— is acruate in shape as at 84 with its sides tapering inwardly in a rearward direction as at 81 from the shoulders 27 and along and below shoulders 32. Also extending rearwardly from each of the shoulders 28 is a further shoulder 32 that is inclined upwardly. The function of the shoulders 28, 32 and the inset portion of the hull 81 is to reduce drag caused by water flowing along the housings —A—, —B— and —C— to a minimum, by preventing the water from flowing over the upper surfaces of the device 10. My water jet propulsion apparatus 10 is mounted on the boat 12 so that when at rest, the device 10 is only partially submerged in the water. When the boat is in motion, the inlet 13 will be completely submerged with the remainder of the device 10 inclined slightly downwardly. If the boat 12 is moving forwardly in the water, the shoulders 28 and the rounded and recessed surfaces 84 of the casting —C— will deflect the water away from device 10. If the boat 12 is moving rearwardly, the shoulders 32 will likewise deflect the oncoming water away from the device 10.

Figure 8:
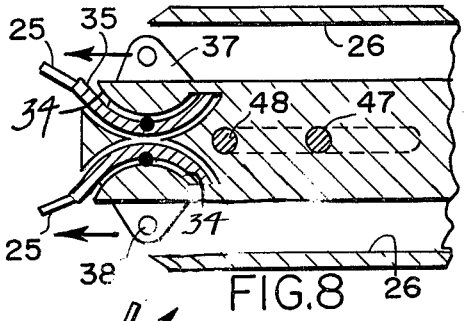
FIGS. 8–12 inclusive are cross sectional views taken along the line 8—8 of FIG. 4 with the slide bar pins and slot shown in dotted lines for the purpose of illustrating the different positions of the water deflecting members for steering the boat and their relation with the slide bar.
Figure 8A:
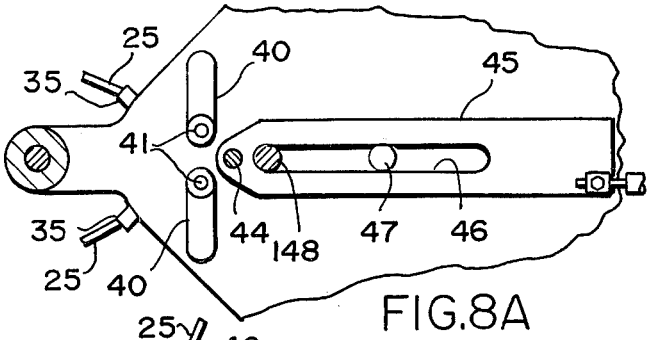
Figure 8B:
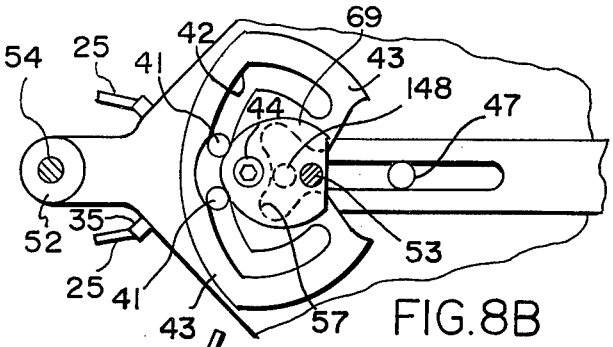
Figure 8C:
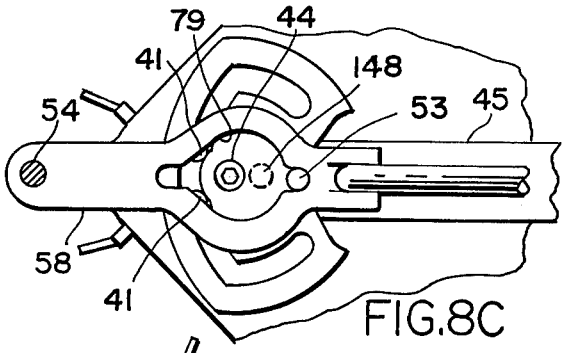
Figure 9B:
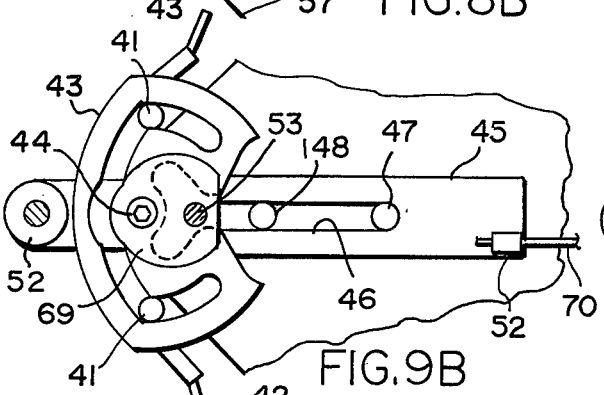
Figure 9C:
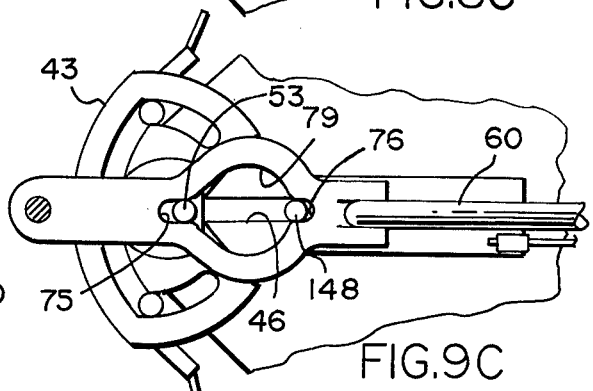
Figure 10B:
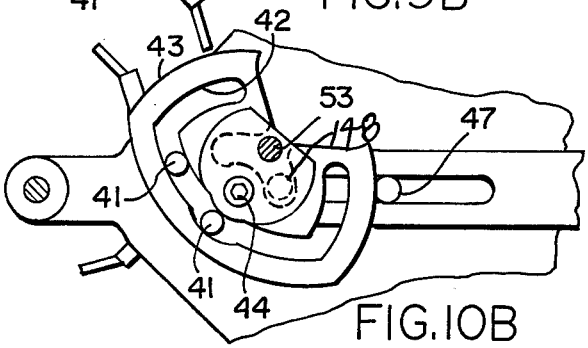
Figure 10C:
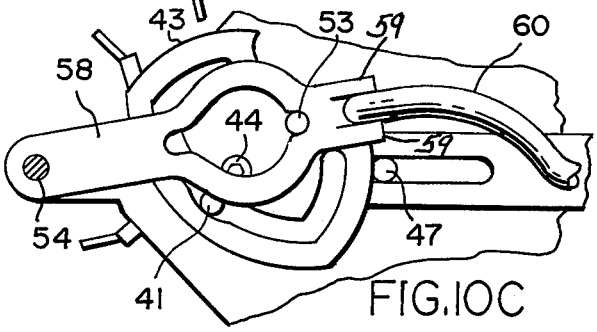
Figure 11B:
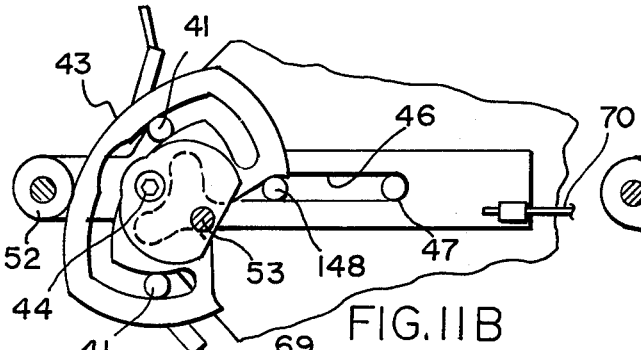
Figure 11C:
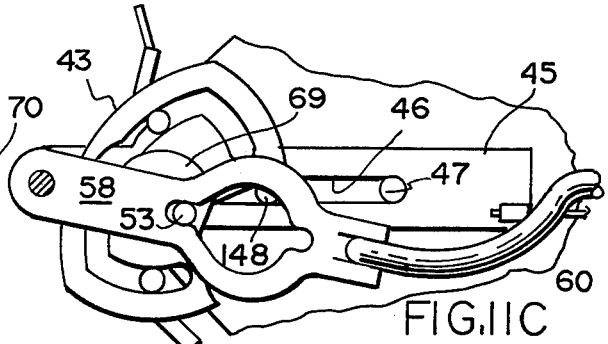

Only two controls are needed to effect the proper steering of my device 10 namely, the handle 74 and a further control, not shown, which control is connected to the cable 70 for actuating the slide bar 45. As illustrated by all of the FIGS. 8–12, 8A–12A, 8B–12B and 8C–12C inclusive, actuating of the handle 74 and the control connected to the cable 70 will effect the forward, reverse and all turning movements of the boat. FIGS. 8, 8A, 8B and 8C show the relative position of various parts of the steering mechanism that cause the boat to travel straight ahead. In this case, the slide bar 45 has been pulled forwardly to slide to its most forward position by means of the cable 70. The cam plate 43 which is pivotable about the pivot pin 44 that secures the slide bar 45 to the cam plate 43 is in axial alignment with the fore and aft axis of the slide bar 45 and also slides forwardly until the pin 48 engages the end of the slot 46 in the forward opening 76 of the cam slot 75. At this position the pins 41 of the cranks 40 will have slid along the cam slot 42 to assume the position on each side of the cam slot 42 as shown by FIG. 8B. As best shown by FIG. 8 the deflector members 35 will be found confined within their respective arcuate slots 34 so that the water being forced through the inlet 13, passageway 20 and outlet 26 will provide a forward thrust to the boat 12 which will then move in a straight forward direction in the water.

If it is desired that the boat 12 be made to move in a straight rearward direction, all that need be done is actuate the control that causes the cable 70 to slide the slide bar 45 to its rearmost position as shown by FIGS. 9, 9A, 9B and 9C. In this instance the pin 47 will abut against the forward end of the slot 46 of the slide bar 45. The cam plate 43 will have slid rearwardly along with the slide bar 45 and the pin 148 carried by the combined cam plate 43 and cover 69 to be received by the opening 76 of the cam slot 79. At this position, the pins 41 will have slid along each side of the cam slot 42 of the cam plate 43 and the deflectors 35 will be found in the position shown by FIG. 9 in the path of the water being discharged through the discharge ducts 26. Water being discharged will be deflected forwardly at an acute angle with relation to the axis of the boat on each side of the boat so that the boat 12 will move rearwardly in a straight direction.

Figure 10:
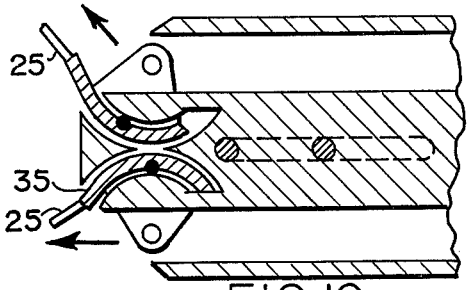

If it is desired to turn while moving in a forwardly direction, the slide bar 45 is made to slide to its forward most position as explained above in connection with FIGS. 8, 8A, 8B and 8C and the handle 74 is actuated to cause the cam plate to pivot in the direction the boat is to be made to turn. As shown by FIGS. 10, 10A, 10B and 10C, by pulling forwardly on the cable 70 the deflector members 35 are made to slide into the arcuate slots 35 leaving the passageways 26 unobstructed so that the boat now moves forwardly. By swinging the handle 74, the swing bar 61 will rotate causing the arcuate end portion 60 and the special wall members 59 to swing thereby causing the swing arm 58 to pivot about the pin 54. Since the pin 53 is positioned in the opening 76, it will swing with the swing arm 58 carrying with itself the cam plate 43 that pivots about the pivot pin 54. The turning of the cam plate 43 will cause one of the pins 41 to remain unmoved in the slot 42 while the other pin 41 will move a distance within the slot 42 depending upon the amount of turn imposed on the cam plate 43. The deflector 35 connected to the pin 41 that did not move in the slot 42 will remain out of the path of the discharged water while the other pin 41 will have caused the deflector 35 to have pivoted into the path of the discharged water to cause the boat 12 to turn to the left as it moved forwardly in the water as shown by FIG. 10. The pin 148 engages the side edges of the cam slot 57 to limit the pivotal movement of the swing arm 58 to the maximum amount to which it is desired to steer the boat.

Figure 11:
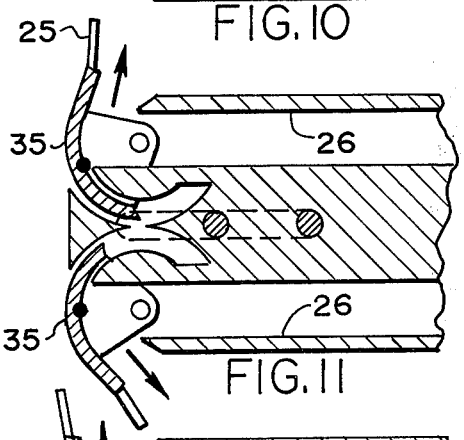
Figure 11A:
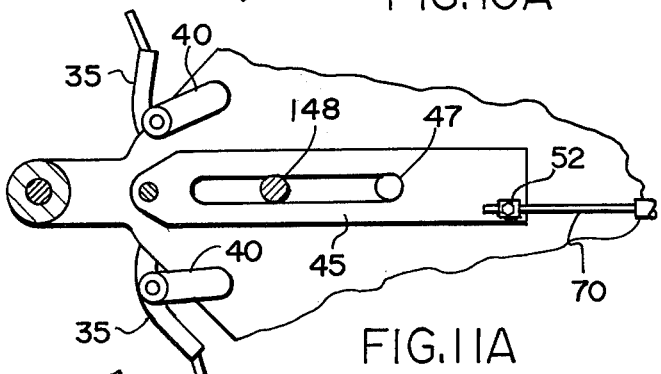
Figure 12:
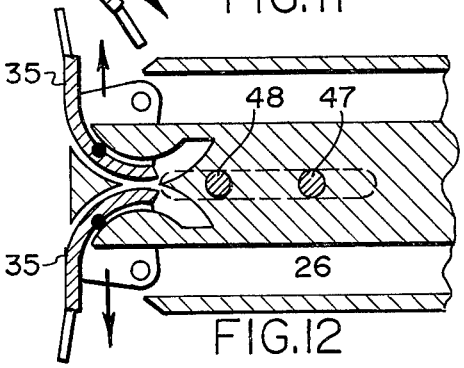
Figure 12A:
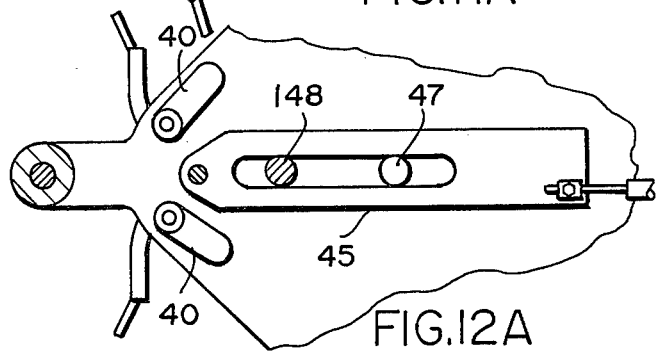

To cause the boat to turn while moving in reverse, the slide bar 45 is brought to its rearmost position to permit the pin 148 to slide out of the slot 57 through the opening 85 and then causing the pivotal movement of the cam plate 43 in the direction it is desired that the boat be made to turn. As shown by FIGS. 11, 11A, 11B and 11C, the rearmost positioning of the slide bar 45 causes the deflector members 35 to pivot out of the arcuate slots 34 and into the path of the water flowing through the passageways 26. Upon actuating the handle 74 to cause the cam plate 43 to pivot about its pivot pin 44 in a clockwise direction, the deflector members 35 will pivot about their pivot pins 38, 39 to the extent that their respective cam pins 41 slide along the cam slot 42. In this instance, the upper or left deflector plate 35 as seen in FIG. 11, will have pivoted less than the other so that the water being discharged through the passageway 26 impinging on the lower deflector member 35 will be deflected toward a more forwardly direction than by the other deflector member 35 and so the boat will move rearwardly and to the right. The ends of the edge portions 86 of the cam 43 form a stop for the pin 148 to limit the turning movement of the boat.

Figure 9:
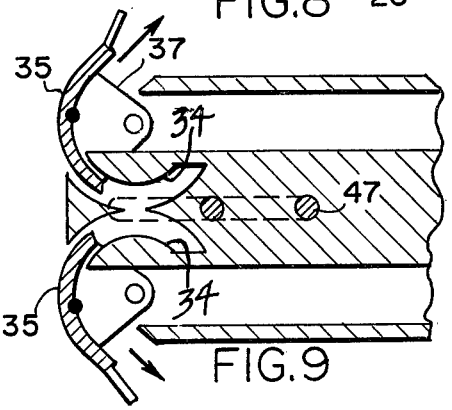
Figure 9A:
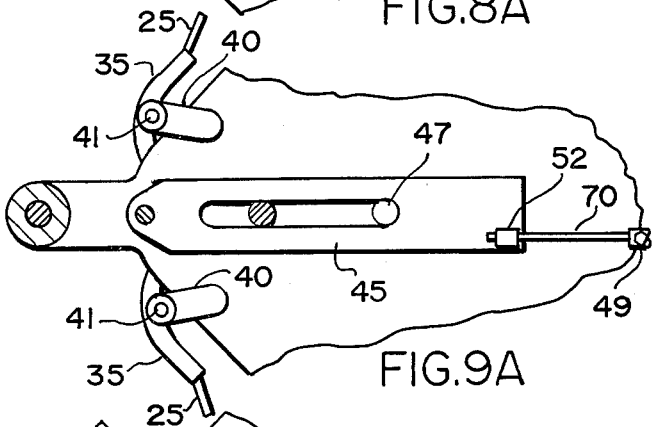
Figure 10A:
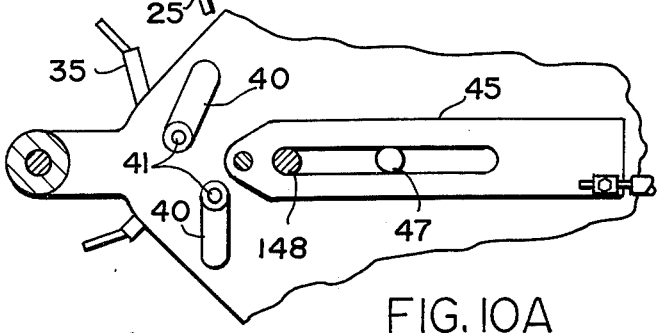

If it is desired to place the boat in a neutral or non-moving position, the slide bar 45 is caused to be moved to a mid-position between that of its rearmost position as shown by FIG. 9A and its forwardmost position as shown by FIG. 10A. In this position the pin 148 will be positioned at the opening 85 of the cam plate 43 and the deflector members 35 will have slid out of their arcuate slots 34 and extend part way across the outlet of the water passageways 26. The water is so deflected that they flow at right angle to the axis of the device 10 in two streams whose momentum counteract each other to compel the boat to remain motionless in the water. See FIGS. 12, 12A, 12B and 12C.

Figure 12B:
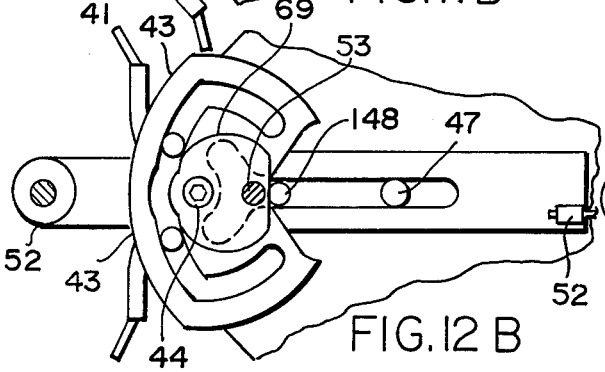
Figure 12C:
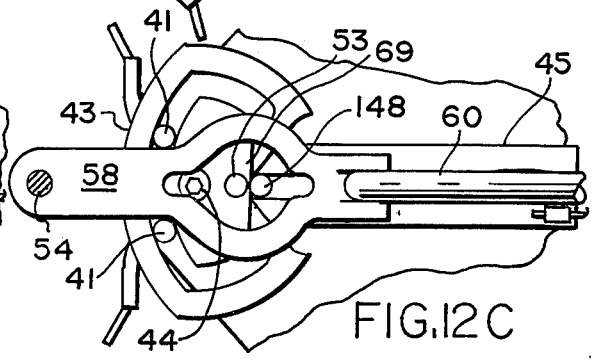
Figure 13:
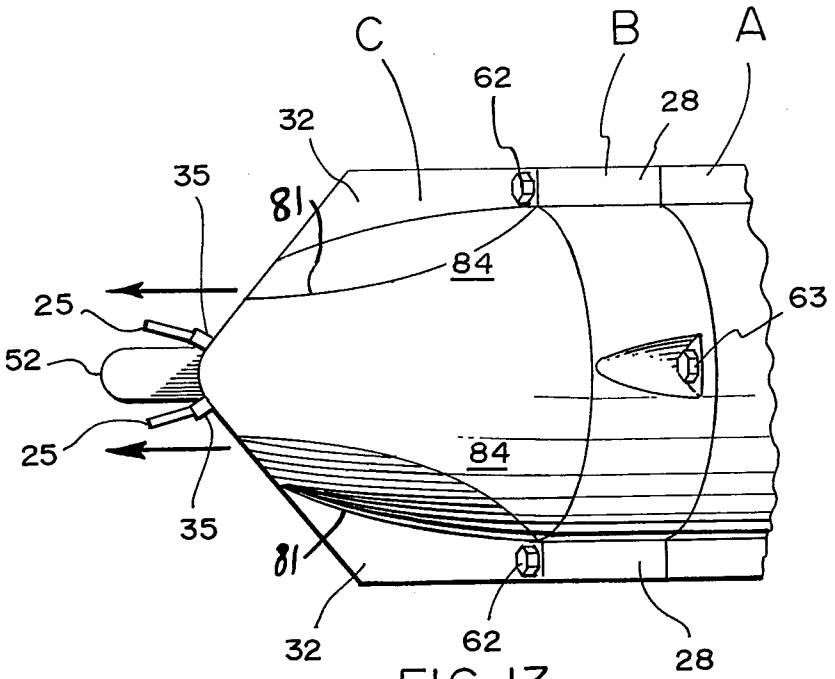
FIG. 13 is a bottom plan view of the rear portion of my water jet propulsion device shown only in part.
Figure 14:
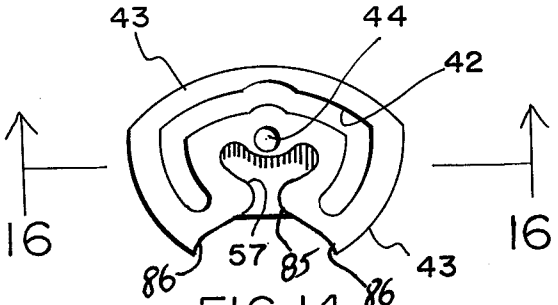
FIGS. 14 and 15 are top plan and end views of the cam plate.
Figure 15:
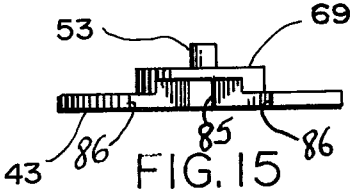
Figure 16:
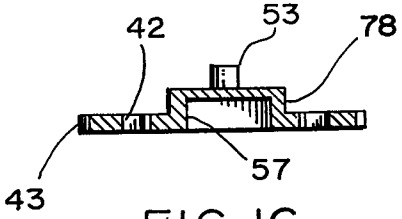
FIG. 16 is a cross sectional view taken along the line 16—16 of FIG. 14.

When the device 10 is in its neutral position, the steering or turning mechanism is rendered inoperable by virtue of the pin 148 that is affixed to the combined cam plate 43 and cam cover 69 which will be positioned within the confines of the circular cam slot 79 and out of contact with the swing arm 58 as shown best by FIG. 12C. Movement of the steering handle 74 will cause the swing arm 58 to pivot about its pivot pin 54 but since the pin 148 is in the approximate center of the circular swing arm alot 79, there can be no contact made by the swing arm 58 engaging the pin 148. Therefore, while in the neutral position, the cam plate 43 is not pivoted out of the position shown by FIGS. 12B and 12C and the deflectors 35 remaining in the position shown by FIG. 12 unaffected by any movement of the steering handle 74.

As stated hereinabove the high efficiency of my water jet propulsion device 10 results from the fact that my device 10 is partially submerged in water to cause the water to flow in a horizontal direction into and through my device. Those of the conventional devices that are completely submerged in the water, though the flow of water therethrough is horizontal, the resistance of the completely submerged device to its movement in the water is considerable and consequently less efficient than my device 10. In addition thereto, those conventional jet propulsion devices that are mounted on a boat out of the water incur a built-in work load that consists of having to lift the water into the device. This head reduces the efficiency of the device considerably and is known to be less efficient than my device 10. In my device, the inlet 13 is positioned below the hull 27 with a portion of the keel at the transom but away so that the inlet 13 is unobstructed. As can be readily seen, water will flow horizontally into and through my jet propulsion device 10. The efficiency of my water jet propulsion device 10 is further increased by preventing the water from flowing over the device, since the device 10 is partially submerged in the water. The combination of the shoulders 28 and 32 extending along each side of the device 10 in alignment with the hull of the boat and the off-setting of the arcuate surface 84 of the casting —C— as at 32, prevent water from flowing over the top of the housings —A—, —B— and —C— but instead deflect the water away from the device 10.

Even when the boat is moving in rearwardly, the water is deflected away from the device 10 by the shoulders 32. All of this reduces the drag or resistance of the device 10 as it moves through the water.

What I claim as new and desire to secure by Letters Patent of the United States is:

1. A water jet propelling apparatus for boats comprising a housing having an inlet and an outlet, a passageway communicating with said inlet and said outlet, water impelling means mounted in said passageway, a plurality of water deflecting members, pivot means mounting said deflecting members at said outlet, crank pins secured to each of said pivot means, a slide plate mounted for longitudinal sliding movement on said housing, a first cam plate, pivot means securing said cam plate to said slide plate, said cam plate having a first slotted portion substantially symmetrically disposed about said pivot means, said slotted portion receiving said crank pins, a second cam plate secured to said first cam plate in spaced relation to the upper surface of said first cam plate, an upwardly extending pin mounted on said second cam plate, an elongated swing arm, pivot means mounting one end of said swing arm to said housing, a second slotted portion having a recess at each end mounted on said swing arm, said pin being adapted to be received by either of said recesses, and control means mounted at the other end of said swing arm for swinging said swing arm whereby said first cam plate is pivoted to effect a sliding of said crank pins in said first slotted portion and the pivotal movement of said water deflecting members for steering said boat.

2. The structure as recited by claim 1 taken in combination with a second pin extending upwardly of said housing in alignment with said first cam plate, pivot means, said first cam plate having a further slotted portion received by said second pin, an opening in said slotted portion permitting said second pin to slide in and out of said further slotted portion.

3. The structure as recited in claim 2 taken in combination with means mounted on said first cam plate engaged by said second pin limiting the swinging movement of said swing arm in the steering of said boat.

4. The structure as recited by claim 1 wherein said control means comprises a pair of spaced apart members, an elongated rotatable shaft, and arcuate member connected to said shaft and extending between said spaced members and a handle mounted at the free end of said shaft for rotating said shaft and swinging said arcuate member to effect the pivotal movement of said swing arm.

5. The structure as recited by claim 3 wherein said control means comprises a pair of spaced apart members, an elongated rotatable shaft, an arcuate member connected to said shaft and extending between said spaced members and a handle mounted at the free end of said shaft for rotating said shaft and swinging said arcuate member to effect the pivotal movement of said swing arm.

* * * * *